US008217562B2

(12) United States Patent
Ohm et al.

(10) Patent No.: US 8,217,562 B2
(45) Date of Patent: Jul. 10, 2012

(54) IGNITION PLUG

(75) Inventors: Dae Yeol Ohm, Seoul (KR); Nack J. Kim, Pohang (KR); Jun Ho Bae, Gyeongsangbuk-do (KR); Seok Ki Song, Daejeon (KR); Hyun Joong Kim, Cheongju (KR); Jong Hyun Im, Chungcheongbuk-do (KR)

(73) Assignee: Yura Tech Co., Ltd. (KR)

( * ) Notice: Subject to any disclaimer, the term of this patent is extended or adjusted under 35 U.S.C. 154(b) by 38 days.

(21) Appl. No.: 12/525,398

(22) PCT Filed: Sep. 21, 2007

(86) PCT No.: PCT/KR2007/004683

§ 371 (c)(1),
(2), (4) Date: Jul. 31, 2009

(87) PCT Pub. No.: WO2008/093922

PCT Pub. Date: Aug. 7, 2008

(65) Prior Publication Data

US 2010/0026159 A1 Feb. 4, 2010

(30) Foreign Application Priority Data

Jan. 31, 2007 (KR) ..... 10-2007-0009963

(51) Int. Cl.
*H01T 13/20* (2006.01)

(52) U.S. Cl. ..... 313/141; 313/143

(58) Field of Classification Search ..... 313/118, 313/141–143; 123/143, 169 R; 445/7
See application file for complete search history.

(56) References Cited

U.S. PATENT DOCUMENTS 6,304,022 B1 * 10/2001 Matsutani ..... 313/141
6,750,598 B2 6/2004 Hori
6,885,135 B2 4/2005 Kanao et al.
2006/0028106 A1 2/2006 Lineton et al.
2006/0158082 A1 * 7/2006 Menken et al. ..... 313/141

FOREIGN PATENT DOCUMENTS

| | | |
|---|---|---|
| JP | 09-291327 | 11/1997 |
| JP | 10-022051 | 1/1998 |
| JP | 11-054240 | 2/1999 |
| WO | 2004/007782 | 1/2004 |

OTHER PUBLICATIONS

International Search Report—PCT/KR2007/004683 dated Dec. 26, 2007.
Written Opinion—PCT/KR2007/004683 dated Dec. 26, 2007.
Japanese Office Action—Japanese Application No. 2009-548137 issued on Jul. 19, 2011, citing JP 11-54240.
Chinese Office Action—Chinese Application No. 200780050759.9 issued on May 26, 2011, citing JP 09-291327, US 2006/0028106, and WO 2004/007782.
Office Action issued Sep. 15, 2010 by State Intellectual Property Office—CN200780050759.9, citing JP 10-22051.

* cited by examiner

*Primary Examiner* — Karabi Guharay
*Assistant Examiner* — Elmito Breval
(74) *Attorney, Agent, or Firm* — Cantor Colburn LLP

(57) ABSTRACT

Provided is an ignition plug used for an internal-combustion engine. The ignition plug includes: a center electrode; an insulator disposed outside the center electrode; a metal housing disposed outside the insulator; a ground electrode having an end connected to the metal housing and the other end facing the center electrode; and an electrode tip fixed to one or more of the center electrode and the ground electrode. The electrode tip is made of an alloy of iridium Ir, hafnium Hf, and niobium Nb. Therefore, the ignition plug with the low-cost iridium can have high resistance to prevent an iridium element from oxidizing and vaporizing in high speed driving conditions.

10 Claims, 2 Drawing Sheets

[Fig. 1]
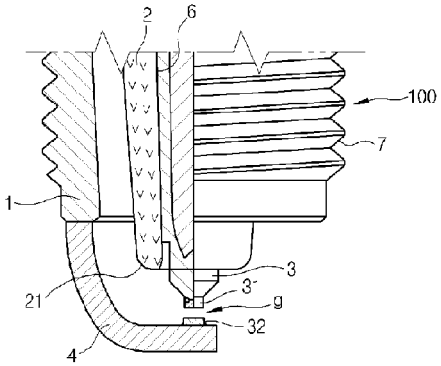
[Fig. 2]
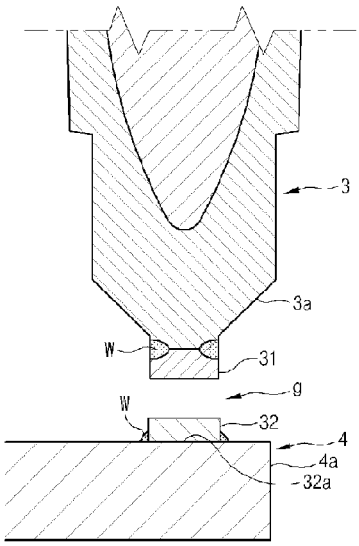
[Fig. 3]
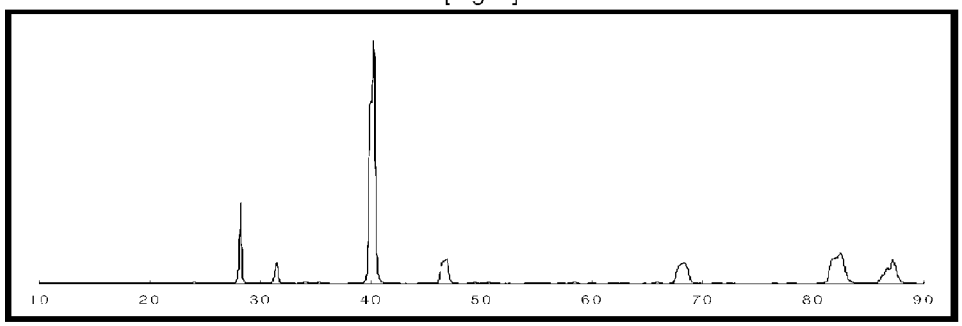

[Fig. 4]
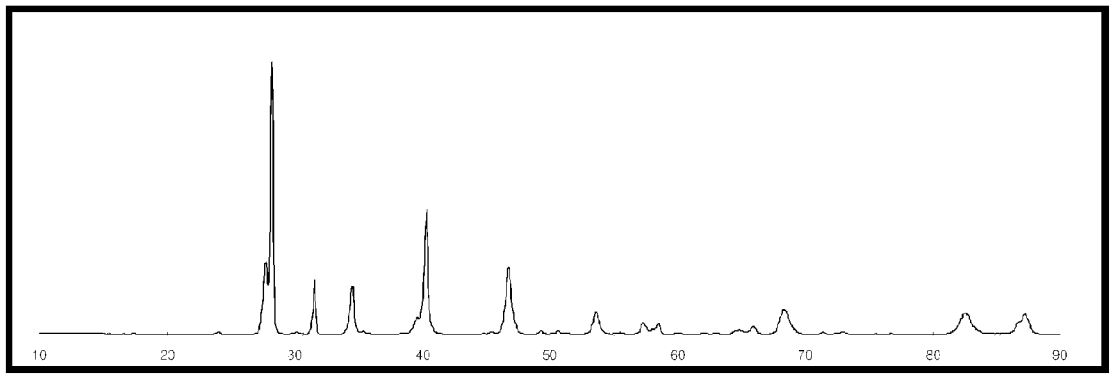

IGNITION PLUG

TECHNICAL FIELD

The present invention relates to a ignition plug for an internal-combustion engine.

BACKGROUND ART

A conventional ignition plug for an internal-combustion engine such as a car engine uses an electrode tip made of precious metals such as platinum for an end portion of an electrode in order to increase resistance to spark consumption. However, since the precious metals are very expensive and generally used for luxury cars, iridium Ir is generally used for low cost cars.

However, there is a problem in that the iridium is easily oxidized and vaporized at a high temperature of 900 to 1000° C. Therefore, when the iridium is directly used for a spark portion of the electrode, the iridium may be rapidly consumed by oxidation and vaporization. Accordingly, although the ignition plug using the iridium for the spark portion of the electrode has high durability in a low-temperature condition such as in city road driving conditions, the durability of the ignition plug significantly decreases in high speed driving conditions.

Specifically, the iridium that is a main element of the electrode tip is combined with oxygen when oxidized. The generated iridium oxide $IrO_2$ has non-volatile property and corrosion resistance. However, as a temperature increases (to about 900° C.), volatile iridium oxide $IrO_3$ is generated. A temperature in a cylinder normally increases to about 100° C. and sometimes increases to about 2000° C., so that the iridium oxide $IrO_3$ having volatility is mainly generated. In order to cover the iridium oxide $IrO_3$ having low corrosion resistance, rhodium Rh is widely used. When an iridium-rhodium Ir—Rh alloy is oxidized at a high temperature, rhodium oxide $RhO_2$ is generated at a surface of the alloy and covers a surface of the electrode tip, and this prevents the iridium oxide $IrO_3$ from volatilizing. Accordingly, the electrode tip can be prevented from being rapidly consumed at a high temperature.

However, the rhodium Rh is also expensive, so that an alloy which is cheap and has a similar performance is needed.

DISCLOSURE

Technical Problem

The present invention provides an ignition plug using low-cost iridium and having high resistance to prevent an iridium element from oxidizing and vaporizing in a high-temperature condition such as in high speed driving conditions in addition to in a low-temperature condition such as in city road driving conditions.

Technical Solution

According to an aspect of the present invention, there is provided an ignition plug including: a center electrode; an insulator disposed outside the center electrode; a metal housing disposed outside the insulator; a ground electrode having an end connected to the metal housing and the other end facing the center electrode; and an electrode tip fixed to one or more of the center electrode and the ground electrode, wherein the electrode tip is made of an alloy of iridium Ir, hafnium Hf, and niobium Nb.

In the above aspect of the present invention, the electrode tip may include the hafnium of from 0.1 wt % to 5.0 wt %.

In addition, the electrode tip may include the niobium Nb of from 0.1 wt % to 7.0 wt %.

According to another aspect of the present invention, there is provided an ignition plug including: a center electrode; an insulator disposed outside the center electrode; a metal housing disposed outside the insulator; a ground electrode having an end connected to the metal housing and the other end facing the center electrode; and an electrode tip fixed to one or more of the center electrode and the ground electrode, wherein the electrode tip is made of an alloy of iridium Ir, rhodium Rh, and hafnium Hf In the above aspect of the present invention, the electrode tip may include the hafnium of from 0.01 wt % to 3.0 wt %.

In addition, the electrode tip may further include the niobium Nb.

In addition, the electrode tip may include the niobium Nb of from 0.01 wt % to 5.0 wt %.

According to another aspect of the present invention, there is provided an ignition plug including: a center electrode; an insulator disposed outside the center electrode; a metal housing disposed outside the insulator; a ground electrode having an end connected to the metal housing and the other end facing the center electrode; and an electrode tip fixed to one or more of the center electrode and the ground electrode, wherein the electrode tip is made of an alloy of iridium Ir and ruthenium Ru.

In the above aspect of the present invention, the electrode tip may include the ruthenium Ru of from 1.0 wt % to 5.0 wt %.

In addition, the electrode tip may further include hafnium Hf.

In addition, the electrode tip may include the hafnium Hf of from 0.01 wt % to 3.0 wt %.

In addition, the electrode tip may further include niobium Nb.

In addition, the electrode tip may include the niobium Nb of 0.01 wt % to 5.0 wt %.

Advantageous Effects

The previously described version of the present invention have many advantages including follows. However, the present invention does not require that all the advantageous features and all the advantages to be incorporated into every embodiment of the invention.

The ignition plug with low-cost iridium according to the present invention can have high resistance to prevent an iridium element from oxidizing and vaporizing in high speed driving conditions in addition to in a low-temperature condition such as in city road driving conditions.

While the present invention has been particularly shown and described with reference to exemplary embodiments thereof, it will be understood by those skilled in the art that various changes in form and details may be made therein without departing from the spirit and scope of the present invention as defined by the appended claims.

DESCRIPTION OF DRAWINGS

FIG. 1 is a cross-sectional view illustrating a portion of an ignition plug.

FIG. 2 is an expanded sectional view illustrating portions of a center electrode and a ground electrode of FIG. 1.

FIG. 3 is a graph showing a composition analysis result of an electrode tip before oxidization according to a first embodiment of the present invention.

FIG. 4 is a graph showing a composition analysis result of the electrode tip of FIG. 3 after oxidization.

BEST MODE

Hereinafter, exemplary embodiments of the present invention will be described in detail with reference to the attached drawings.

In the description, the detailed descriptions of well-known functions and structures may be omitted so as not to hinder the understanding of the present invention.

FIG. 1 is a cross-sectional view illustrating a portion of an ignition plug.

Referring to FIG. 1, the ignition plug includes a center electrode 3, an insulator 2 disposed outside the center electrode 3, a metal housing 1 disposed outside the insulator 2, and a ground electrode 4 having an end connected to the metal housing 1 and the other end facing the center electrode 3. Electrode tips 31 and 32 are provided to the center electrode 3 and the ground electrode 4, respectively, to face each other.

FIG. 2 is an expanded sectional view illustrating portions of the center electrode and the ground electrode of FIG. 1.

Referring to FIG. 2, a main body 3*a* of the center electrode 3 is tapered at an end portion of the center electrode 3, and a surface of the end portion is formed to be flat. The electrode tip 31 formed in a shape of a disk is disposed at the flat end portion, and by applying a proper welding technique such as laser welding, electron beam welding, resistance welding, and the like to an outer surface of a connection surface to form a welding line W, so that the electrode tip 31 can be securely fixed to the surface of the end portion of the center electrode 3. The facing electrode tip 32 is disposed at the ground electrode 4, and a welding line W is formed at an outer surface of a connection surface, so that the electrode tip 32 can be securely fixed to the ground electrode 4.

According to cases, one of the two facing electrode tips 31 and 32 may be omitted. In this case, a spark discharge gap g is formed between one of the electrode tips 31 and 32 and the ground electrode 4 (or the center electrode 3).

The electrode tips 31 and 32 may be made of a material obtained by melting the mixture of alloy, dense alloy powder, or a sintered material obtained by mixing basic metal powder at a specific ratio and sintering the dense alloy powder.

When the electrode tips 31 and 32 are made of the melt alloy, one or more processes of rolling, tempering, spreading, cutting, shearing, and sintering are performed on a raw material of the melt alloy to manufacture the electrode tips in predetermined shapes.

Now, alloy composition of the electrode tip is described.

As described above, the rhodium oxide $RhO_2$ has a function of preventing the iridium oxide $IrO_3$ from volatilizing by covering surfaces of the electrode tip. An object of the present invention is to develop an additive element to enable the rhodium Rh to perform the aforementioned function. Various experiments are performed on alloys including various kinds of elements having high hardness. As a result, alloy elements having effective performances as described in following embodiments are discovered.

Embodiment 1

FIGS. 3 and 4 illustrate X-ray diffraction analysis results of elements of an electrode tip according to the first embodiment.

The electrode tip according to the embodiment 1 is an alloy having a composition ratio of Ir—Hf3.0 wt %-Nb5.0 wt %. FIG. 3 is a graph showing a composition analysis result before oxidation, and FIG. 4 is a graph showing a composition analysis result after oxidation.

In the graph before oxidation, an element having the highest peak value is iridium-hafnium $Ir_3Hf$. In the graph after oxidation, the iridium-hafnium $Ir_3Hf$ is reduced, and hafnium oxide $HfO_2$ is generated. Specifically, in the graph after oxidation, the hafnium oxide $HfO_2$ has the highest peak value. The hafnium oxide $HfO_2$ is formed at a surface of the iridium Ir tip as the rhodium oxide $RhO_2$ and has a function of preventing the iridium oxide $IrO_3$ having volatility from volatilizing.

In order to demonstrate the function, gap growth rates are measured while composition ratios of the hafnium Hf and niobium Nb are changed. The gap growth rate is a rate of a gap growing from an initial gap. Experiments are performed in a condition in which the engine experiment apparatus is operated at 6,000 rpm for 300 hours. Experiments according to embodiments described later are performed in the same condition.

Results are obtained as the following Table 1.

TABLE 1

| Composition Ratio | Gap Growth Rate |
|---|---|
| Ir (Hf, not included) | 0.45 |
| Ir—Hf 0.1 wt % | 0.30 |
| Ir—Hf 1.0 wt % | 0.27 |
| Ir—Hf 3.0 wt % | 0.26 |
| Ir—Hf 4.0 wt % | 0.30 |
| Ir—Hf 5.0 wt % | 0.33 |
| Ir—Hf 3.0 wt %—Nb 1.0 wt % | 0.24 |
| Ir—Hf 3.0 wt %—Nb 2.0 wt % | 0.22 |
| Ir—Hf 3.0 wt %—Nb 3.0 wt % | 0.18 |
| Ir—Hf 3.0 wt %—Nb 4.0 wt % | 0.16 |
| Ir—Hf 3.0 wt %—Nb 5.0 wt % | 0.15 |
| Ir—Hf 3.0 wt %—Nb 6.0 wt % | 0.22 |
| Ir—Hf 3.0 wt %—Nb 7.0 wt % | 0.23 |
| Ir—Hf 3.0 wt %—Nb 8.0 wt % | 0.26 |

According to results of the experiments, it can be seen that when the hafnium Hf is added to the alloy including the iridium Ir, the gap growth rates at the composition ratios with the hafnium Hf of from 0.1 wt % to 5.0 wt % are significantly decreased as compared with the alloy including only the iridium Ir. In addition, the alloy having the composition ratio of Ir—Hf 3.0 wt % has the smallest gap growth rate. When the niobium Nb is added thereto, the gap growth rates are decreased except for one case. Particularly, it can be seen that the gap growth rates are significantly decreased at the composition ratios with the niobium of 1.0 wt % to 7.0 wt %.

Embodiment 2

According to the embodiment 2, experiments are performed on alloys having the composition ratios of Ir—Rh 5.0 wt % with different weights of the hafnium Hf and the niobium Nb.

Results are obtained as the following Table 2.

TABLE 2

| Composition Ratio | Gap Growth Rate |
|---|---|
| Ir—Rh 5.0 wt %—Hf 0.1 wt % | 0.24 |
| Ir—Rh 5.0 wt %—Hf 0.5 wt % | 0.21 |
| Ir—Rh 5.0 wt %—Hf 1.0 wt % | 0.15 |

TABLE 2-continued

| Composition Ratio | Gap Growth Rate |
|---|---|
| Ir—Rh 5.0 wt %—Hf 1.5 wt % | 0.16 |
| Ir—Rh 5.0 wt %—Hf 3.0 wt % | 0.17 |
| Ir—Rh 5.0 wt %—Hf 1.0 wt %—Nb 0.1 wt % | 0.14 |
| Ir—Rh 5.0 wt %—Hf 1.0 wt %—Nb 0.5 wt % | 0.13 |
| Ir—Rh 5.0 wt %—Hf 1.0 wt %—Nb 1.0 wt % | 0.12 |
| Ir—Rh 5.0 wt %—Hf 1.0 wt %—Nb 3.0 wt % | 0.09 |
| Ir—Rh 5.0 wt %—Hf 1.0 wt %—Nb 5.0 wt % | 0.13 |

According to results of the experiments, the alloys including the rhodium Rh and the hafnium Hf have much smaller gap growth rates as compared with the alloy only including the iridium Ir. Particularly, the alloy having the composition ratio of Ir—Rh 5.0 wt %-Hf 1.0 wt % has the smallest gap growth rate. When the niobium Nb is added, it can be seen that the gap growth rates are significantly reduced at composition ratios with the niobium Nb of from 0.1 wt % to 5.0 wt %. Particularly, it can be seen that the gap growth rates are significantly decreased at the composition ratio with the niobium Nb of about 3.0 wt %.

Embodiment 3

According to the embodiment 3, experiments are performed on alloys including iridium-rhodium Ir—Rh 3.0 wt % with different weight of the hafnium Hf. In addition, the alloys including the hafnium Hf having very small weights as compared with the embodiment 2 are examined.

Results are obtained as the following Table 3.

TABLE 3

| Composition Ratio | Gap Growth Rate |
|---|---|
| Ir—Rh 3.0 wt %—Hf 0.01 wt % | 0.07 |
| Ir—Rh 3.0 wt %—Hf 0.05 wt % | 0.08 |
| Ir—Rh 3.0 wt %—Hf 0.1 wt % | 0.07 |
| Ir—Rh 3.0 wt %—Hf 0.2 wt % | 0.07 |
| Ir—Rh 3.0 wt %—Hf 0.5 wt % | 0.08 |
| Ir—Rh 3.0 wt %—Hf 1.0 wt % | 0.12 |
| Ir—Rh 3.0 wt %—Hf 2.0 wt % | 0.18 |
| Ir—Rh 3.0 wt %—Hf 3.0 wt % | 0.23 |

According to results of the experiments, it can be seen that the alloys including the rhodium Rh and the hafnium Hf have much smaller gap growth rates as compared with that including only the iridium Ir. When it is assumed that the alloys have durability higher than that including only the iridium Ir when the gap growth rates of the alloys are practically smaller than 3.0, the alloys having the composition ratios with the hafnium Hf of from 0.01 wt % to 3.0 wt % have improved durability. In this case, the electrode tip including the hafnium Hf of more than 3.0 wt % cannot be manufactured due to fragility.

Embodiment 4

According to the embodiment 4, experiments are performed on alloys including the iridium-rhodium Ir—Rh 3.0 wt %-Hf 0.01 wt % with different weights of the niobium Nb.

Results are obtained as the following Table 4.

TABLE 4

| Composition Ratio | Gap Growth Rate |
|---|---|
| Ir—Rh 3.0 wt %—Hf 0.010 wt %—Nb 0.01 wt % | 0.15 |
| Ir—Rh 3.0 wt %—Hf 0.010 wt %—Nb 0.05 wt % | 0.13 |

TABLE 4-continued

| Composition Ratio | Gap Growth Rate |
|---|---|
| Ir—Rh 3.0 wt %—Hf 0.010 wt %—Nb 0.1 wt % | 0.11 |
| Ir—Rh 3.0 wt %—Hf 0.010 wt %—Nb 0.2 wt % | 0.11 |
| Ir—Rh 3.0 wt %—Hf 0.010 wt %—Nb 0.5 wt % | 0.12 |
| Ir—Rh 3.0 wt %—Hf 0.010 wt %—Nb 1.0 wt % | 0.06 |
| Ir—Rh 3.0 wt %—Hf 0.010 wt %—Nb 2.0 wt % | 0.08 |
| Ir—Rh 3.0 wt %—Hf 0.010 wt %—Nb 3.0 wt % | 0.13 |
| Ir—Rh 3.0 wt %—Hf 0.010 wt %—Nb 5.0 wt % | 0.22 |
| Ir—Rh 3.0 wt %—Hf 0.010 wt %—Nb 8.0 wt % | 0.35 |

According to results of the experiments, the alloys having the composition ratios with the niobium Nb of from 0.01 wt % to 5.0 wt % have the gap growth rates of less than 0.3. Particularly, the gap growth rate is significantly decreased at the composition ratio with the niobium of about 1.0 wt %.

Embodiment 5

According to the embodiment 5, experiments are performed on alloys including iridium-ruthenium Ir—Rh with different composition ratios.

Results are obtained as the following Table 5.

TABLE 5

| Composition Ratio | Gap Growth Rate |
|---|---|
| Ir (Ru, not included) | 0.45 |
| Ir—Ru 0.5 wt % | 0.31 |
| Ir—Ru 1.0 wt % | 0.22 |
| Ir—Ru 2.0 wt % | 0.16 |
| Ir—Ru 3.0 wt % | 0.13 |
| Ir—Ru 4.0 wt % | 0.07 |
| Ir—Ru 5.0 wt % | 0.22 |
| Ir—Ru 7.0 wt % | 0.32 |

According to results of the experiments, the alloys including the ruthenium Ru have wear rates smaller than that of the alloy only including the iridium Ir. Particularly, alloys having the composition ratios with the ruthenium Ru of from 0.5 wt % to 5.0 wt % have the gap growth rates of less than 0.3, and this means the alloys have improved abrasion resistance.

Embodiment 6

According to the embodiment 6, experiments are performed on alloys including iridium-ruthenium Ir—Ru 4.0 wt % with different weights of the hafnium Hf.

Results are obtained as the following Table 6.

TABLE 6

| Composition Ratio | Gap Growth Rate |
|---|---|
| Ir—Ru 4.0 wt %—Hf 0.01 wt % | 0.08 |
| Ir—Ru 4.0 wt %—Hf 0.05 wt % | 0.10 |
| Ir—Ru 4.0 wt %—Hf 0.1 wt % | 0.09 |
| Ir—Ru 4.0 wt %—Hf 0.2 wt % | 0.11 |
| Ir—Ru 4.0 wt %—Hf 0.5 wt % | 0.13 |
| Ir—Ru 4.0 wt %—Hf 1.0 wt % | 0.14 |
| Ir—Ru 4.0 wt %—Hf 2.0 wt % | 0.14 |
| Ir—Ru 4.0 wt %—Hf 3.0 wt % | 0.14 |

According to results of the experiments, the alloys having the ruthenium Ru and the hafnium Hf have much smaller gap growth rates as compared with the alloy only including the iridium Ir. When it is assumed that the alloys have durability higher than that only including the iridium Ir when the gap growth rates of the alloys are practically smaller than 3.0, the alloys having the composition ratios with the hafnium Hf of from 0.01 wt % to 3.0 wt % have improved durability. In this case, the electrode tip including the hafnium Hf of more than 3.0 wt % cannot be manufactured due to fragility.

Embodiment 7

According to the embodiment 7, experiments are performed on alloys including the iridium-ruthenium Ir—Ru 4.0 wt %-Hf 0.01 wt % with different weights of the niobium Nb.

Results are obtained as the following Table 7.

TABLE 7

| Composition Ratio | Gap Growth Rate |
|---|---|
| Ir—Ru 4.0 wt %—Hf 0.010 wt %—Nb 0.01 wt % | 0.14 |
| Ir—Ru 4.0 wt %—Hf 0.010 wt %—Nb 0.05 wt % | 0.13 |
| Ir—Ru 4.0 wt %—Hf 0.010 wt %—Nb 0.1 wt % | 0.12 |
| Ir—Ru 4.0 wt %—Hf 0.010 wt %—Nb 0.2 wt % | 0.13 |
| Ir—Ru 4.0 wt %—Hf 0.010 wt %—Nb 0.5 wt % | 0.10 |
| Ir—Ru 4.0 wt %—Hf 0.010 wt %—Nb 1.0 wt % | 0.10 |
| Ir—Ru 4.0 wt %—Hf 0.010 wt %—Nb 2.0 wt % | 0.07 |
| Ir—Ru 4.0 wt %—Hf 0.010 wt %—Nb 3.0 wt % | 0.09 |
| Ir—Ru 4.0 wt %—Hf 0.010 wt %—Nb 5.0 wt % | 0.20 |
| Ir—Ru 4.0 wt %—Hf 0.010 wt %—Nb 8.0 wt % | 0.31 |

According to results of the experiments, the alloys including the niobium Nb of from 0.01 wt % to 5.0 wt % have the gap growth rates of less than 0.3. Particularly, the gap growth rate is significantly decreased at the composition ratio the niobium Nb of about 2.0 wt %.

The ignition plug 100 operates as follows. The ignition plug 100 is engaged with an engine block by a thread portion 7, and the mixture of air and fuel supplied to a combustion chamber is disposed in the spark discharge gap g of the ignition plug 100. The two electrode tips 31 and 32 are made of the aforementioned alloy, so that consumption of the spark portion caused by oxidation and vaporization of the iridium can be suppressed, and the increase in the spark discharge gap g is prevented. Therefore, a life span of the ignition plug 100 can be increased.

The invention claimed is:

1. An ignition plug comprising: a center electrode; an insulator disposed outside the center electrode; a metal housing disposed outside the insulator; a ground electrode having an end connected to the metal housing and the other end facing the center electrode; and an electrode tip fixed to one or more of the center electrode and the ground electrode, wherein the electrode tip is made of an alloy consists of iridium Ir, hafnium Hf in a range of 0.1 wt %~5 wt %, and niobium Nb in a range of 0.1 wt %~7 wt %.

2. The ignition plug of claim 1, wherein the hafnium content of the alloy is in a range of 1.0%~3.0 wt %.

3. The ignition plug of claim 1, wherein the niobium content of the alloy is in a range of 3 wt %~5 wt %.

4. The ignition plug of claim 3, wherein the hafnium content of the alloy is in a range of 1.0 wt %~3.0 wt %.

5. An ignition plug comprising: a center electrode; an insulator disposed outside the center electrode; a metal housing disposed outside the insulator; a ground electrode having an end connected to the metal housing and the other end facing the center electrode; and an electrode tip fixed to at least one of the center electrode and the ground electrode, wherein the electrode tip is made of an alloy consists of iridium Ir, rhodium Rh, and hafnium Hf in a range of 0.01 wt %~3 wt %, niobium Nb in a range of 0.01 wt %~5 wt %.

6. The ignition plug of claim 5, wherein the hafnium content of the alloy is in a range of 1.0 wt %~3.0 wt %.

7. The ignition plug of claim 6, wherein the niobium content of the alloy is in a range of 0.1 wt %~3.0 wt %.

8. The ignition plug of claim 5, wherein the niobium content of the alloy is in a range of 0.1 wt %~3.0 wt %.

9. An ignition plug comprising: a center electrode; an insulator disposed outside the center electrode; a metal housing disposed outside the insulator; a ground electrode having an end connected to the metal housing and the other end facing the center electrode; and an electrode tip fixed to one or more of the center electrode and the ground electrode, wherein the electrode tip is made of an alloy consists of iridium Ir and ruthenium Ru, hafnium Hf in a range of 0.01 wt %~3 wt %, and niobium Nb in a range of 0.01 wt %~5 wt %.

10. The ignition plug of claim 9, wherein the ruthenium content of the alloy is in a range of 1.0 wt %~5.0 wt %.

* * * * *